United States Patent [19]

Tanabe et al.

[11] Patent Number: 4,552,836

[45] Date of Patent: Nov. 12, 1985

[54] SILVER HALIDE COLOR PHOTOGRAPHIC LIGHT-SENSITIVE MATERIAL

[75] Inventors: Osami Tanabe; Kozo Aoki; Akira Ogawa; Makoto Umemoto, all of Kanagawa, Japan

[73] Assignee: Fuji Photo Film Co., Ltd., Kanagawa, Japan

[21] Appl. No.: 601,886

[22] Filed: Apr. 19, 1984

[30] Foreign Application Priority Data

Apr. 21, 1983 [JP] Japan ..... 58-70604

[51] Int. Cl.[4] ..... G03C 7/26

[52] U.S. Cl. ..... 430/549; 430/553

[58] Field of Search ..... 430/549, 553

[56] References Cited

U.S. PATENT DOCUMENTS

| | | | |
|---|---|---|---|
| 2,423,730 | 7/1947 | Salminen et al. | 430/473 |
| 4,334,011 | 6/1982 | Aoki et al. | 430/553 |
| 4,455,367 | 6/1984 | Seoka et al. | 430/553 |

*Primary Examiner*—J. Travis Brown

*Attorney, Agent, or Firm*—Sughrue, Mion, Zinn, Macpeak and Seas

[57] ABSTRACT

A silver halide color photographic light-sensitive material which has superior fastness to both heat and light, exhibits absorption desirable from the viewpoint of color reproduction, and has superior color forming property is disclosed which comprises a support having thereon a cyan dye forming coupler represented by the following general formula (I) and a cyan dye forming coupler represented by the following general formula (II):

(I)

(II)

wherein $R^1$ and $R^4$ each represents a substituted or unsubstituted alkyl, aryl or heterocyclic group, $R^2$, $R^3$ and $R^5$ each represents a hydrogen atom, a halogen atom, or a substituted or unsubstituted alkyl or aryl group, $R^6$ represents a group with which a benzene ring can be substituted, $X^1$ and $X^2$ each represents a group which can be released upon an oxidative coupling reaction with a developing agent, $R^4$ and $R^5$ may combine together to form a 5-membered or 6-membered ring, and n represents an integer of 1 to 5.

10 Claims, No Drawings

SILVER HALIDE COLOR PHOTOGRAPHIC LIGHT-SENSITIVE MATERIAL

FIELD OF THE INVENTION

The present invention relates to a color photographic light-sensitive material containing a cyan dye forming coupler.

BACKGROUND OF THE INVENTION

When a silver halide light-sensitive material is subjected to color development after being exposed to light, an oxidized aromatic primary amine developing agent reacts with a dye forming coupler to form a dye image. Generally in this process, a color reproduction process by a subtractive process is used, wherein dye images of yellow, magenta and cyan which are complement colors of blue, green and red are formed in order to produce blue, green and red.

As the cyan color image forming coupler, a phenol and a naphthol have often been used. However, a color image obtained from using a phenol or a naphthol has many problems in preservability. For example, a color image obtained from a 2-acylaminophenol cyan coupler as described in U.S. Pat. Nos. 2,367,531 and 2,423,730 are generally inferior in fastness to heat, a color image obtained from a 2,5-diacylaminophenol cyan coupler as described in U.S. Pat. Nos. 2,369,929 and 2,772,162 are generally inferior in fastness to light, and a color image obtained from a 1-hydroxy-2-naphthamide cyan coupler is generally insufficient with respect to its fastness to both light and heat.

When these couplers are used independently of one another, the various properties (such as, for example, color forming property, color hue and fastness) which the photographic materials aim to possess cannot often be achieved satisfactorily.

SUMMARY OF THE INVENTION

An object of the present invention is to improve the drawbacks and to provide at low cost a silver halide color light-sensitive material which has superior fastness to both light and heat, exhibits absorption desirable from the viewpoint of color reproduction, and has superior color forming property.

The object of the present invention is accomplished by a silver halide light-sensitive material comprising a support having thereon a cyan dye forming coupler represented by the following general formula (I) and a cyan dye forming coupler represented by the following general formula (II).

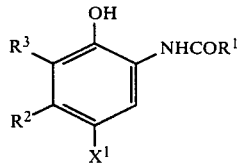

(I)

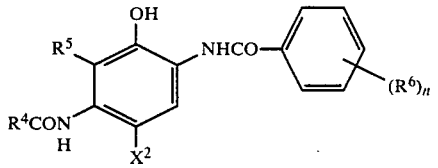

(II)

In the general formulae, $R^1$ and $R^4$ each represents a substituted or unsubstituted alkyl, aryl, or heterocyclic group, $R^2$, $R^3$ and $R^5$ each represents a hydrogen atom, a halogen atom, or a substituted or unsubstituted alkyl or aryl group, $R^6$ represents a group with which a benzene ring can be substituted, $X^1$ and $X^2$ each represents a group which can be released upon an oxidative coupling reaction with a developing agent, $R^4$ and $R^5$ may combine together to form a 5-membered or 6-membered ring, and n represents an integer of 1 to 5.

DETAILED DESCRIPTION OF THE INVENTION

Now, $R^1$, $R^2$, $R^3$, $R^4$, $R^5$, $R^6$, $X^1$, $X^2$ and n used in the foregoing general formulae will be hereinafter described in detail.

In the general formulae (I) and (II), $R^1$ and $R^4$ each represents a substituted or unsubstituted alkyl group, preferably, having 1 to 32 carbon atoms (such as, for example, a methyl group, a butyl group or a tridecyl group), a substituted or unsubstituted aryl group, preferably, having 3 to 32 carbon atoms (such as, for example, a phenyl group or a naphthyl group), or a substituted or unsubstituted 5-membered or 6-membered heterocyclic group, preferably, having 1 to 32 carbon atoms (such as, for example, a 2-pyridyl group, a 2-imidazolyl group, or a 2-furyl group). Examples of the substituents for these groups $R^1$ and $R^4$ include alkyl groups (such as, for example, a methyl group, a butyl group, or a tridecyl group), aryl groups (such as, for example, a phenyl group or a naphthyl group), heterocyclic groups (such as, for example, a 2-pyridyl group, a 2-imidazole group or a 2-furyl group), alkoxy groups (such as, for example, a methoxy group, a dodecyloxy group and a 2-methoxyethoxy group), aryloxy groups (such as, for example, a phenoxy group, a 2,4-di-tert-amylphenoxy group and a 2-chlorophenoxy group), a carboxy group, carbonyl groups (such as, for example, an acetyl group and a benzoyl group), ester groups (such as, for example, a methoxycarbonyl group, a phenoxycarbonyl group, an acetoxy group, a benzoyloxy group, a butoxysulfonyl group and a toluenesulfonyloxy group), amido groups (such as, for example, an acetamido group, an ethylcarbamoyl group, a dimethylcarbamoyl group, a methanesulfonamido group, and a butylsulfamoyl group), sulfamido groups (such as, for example, a dipropylsulfamido group), imido groups (such as, for example, a succinimido group and a hydantoinyl group), ureido groups (such as, for example, a phenylureido group and a dimethylureido group), sulfonyl groups (such as, for example, a methanesulfonyl group), a hydroxy group, a cyano group, a nitro group, halogen atoms (such as, for example, fluorine, chlorine or bromine), and thio groups (such as, for example, an ethylthio group and a phenylthio group).

In the general formulae (I) and (II), $R^2$, $R^3$ and $R^5$ each represents a hydrogen atom, a halogen atom (such as, for example, fluorine, chlorine, or bromine), an alkyl group (such as, for example, a methyl group, an ethyl group or a pentadecyl group), an aryl group (such as, for example, a phenyl group). The alkyl group or the aryl group may be substituted with any of the substituents for those groups $R^1$ and $R^4$ described above.

In the general formulae (I) and (II), $R^6$ represents a group with which a benzene ring can be substituted. Examples of the group include the substituents for those groups $R^1$ and $R^4$ described above and a hydrogen atom.

In the general formulae (I) and (II), $X^1$ and $X^2$ each represents a group which can be released upon an oxidative coupling reaction with a developing agent. Examples of the groups represented by $X^1$ and $X^2$ include a hydrogen atom, halogen atoms (such as, for example, fluorine, chlorine or bromine), alkoxy groups (such as, for example, an ethoxy group, a dodecyloxy group, a methoxyethylcarbamoylmethoxy group, a carboxymethoxy group and a methylsulfonylethoxy group), aryloxy groups (such as, for example, a phenoxy group, a naphthyloxy group and a 4-carboxyphenoxy group), acyloxy groups (such as, for example, an acetoxy group, a tetradecanoyloxy group, and a benzoyloxy group), sulfonyloxy groups (such as, for example, a methanesulfonyloxy group, a toluenesulfonyloxy group), amido groups (such as, for example, a dichloroacetamido group, a heptafluorobutyramido group, a methanesulfonamido group and a toluenesulfonamido group), alkoxycarbonyloxy groups (such as, for example, an ethoxycarbonyloxy group and a benzyloxycarbonyloxy group), aryloxycarbonyloxy groups (such as, for example, a phenoxycarbonyloxy group), thio groups (such as, for example, an ethylthio group, a phenylthio group and a tetrazolylthio group), and imido groups (such as, for example, a succinimido group and a hydantoinyl group).

In the general formula (II), n represents an integer of 1 to 5. When n is 2 or more, a plurality of $R^6$'s may be the same with or different from one another.

Of the cyan couplers represented by the general formula (I), those which are preferred are represented by the following general formula (III).

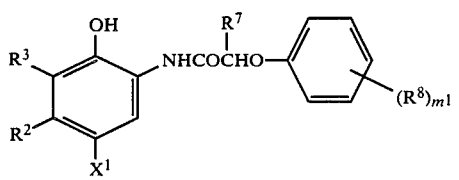

(III)

In the general formula (III), $R^2$, $R^3$ and $X^1$ have the same meanings as defined above, $R^7$ represents a hydrogen atom or an alkyl group which may be substituted, $R^8$ represents a group with which a benzene ring can be substituted, and $m^1$ represents an integer of 1 to 5.

Of the cyan couplers represented by the general formula (II), those which are preferred are represented by the following general formula (IV).

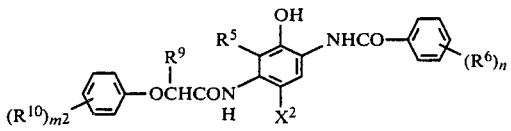

(IV)

In the general formula (IV), $R^5$, $R^6$, $X^2$ and n have the same meanings as defined above, $R^9$ represents a hydrogen atom or an alkyl group which may be substituted, $R^5$ and $R^9$ may combine together to form a 5-membered or 6-membered ring, $R^{10}$ represents a group with which a benzene ring can be substituted, and $m^2$ represents an integer of 1 to 5.

Now, $R^7$, $R^8$, $R^9$, $R^{10}$, $m^1$ and $m^2$ used in the general formulae (III) and (IV) will be hereinafter described in detail.

In the general formulae (III) and (IV), $R^7$ and $R^9$ each represents a hydrogen atom or an alkyl group having 1 to 22 carbon atoms, which may be substituted by any of the substituents for those groups $R^1$ and $R^4$ described above.

In the general formulae (III) and (IV), $R^8$ and $R^{10}$ each represents a group with which a benzene ring can be substituted. Examples of the groups represented by $R^8$ and $R^{10}$ include the substituents for those groups $R^1$ and $R^4$ and a hydrogen atom.

In the general formulae (III) and (IV), $m^1$ and $m^2$ each represents an integer of 1 to 5. When they are each 2 or more, a plurality of $R^8$'s and a plurality of $R^{10}$'s may be the same with or different from one another.

In the general formula (III), $R^2$ preferably represents an alkyl group.

In the general formula (III), $R^3$ preferably represents a hydrogen atom, a phenyl group or a halogen atom, and $R^3$ particularly preferably represents fluorine or chlorine.

In the general formula (III), $R^7$ preferably represents a hydrogen atom or an unsubstituted alkyl group having 1 to 22 carbon atoms.

In the general formula (III), $R^8$ preferably represents an alkyl group, and $R^8$ particularly preferably represents a branched alkyl group.

In the general formula (III), $m^1$ preferably represents an integer of 1 to 3, $m^1$ particularly preferably represents an integer of 2.

In the general formula (III), $X^1$ preferably represents a hydrogen atom, a halogen atom, an alkoxy group or an aryloxy group, $X^1$ particularly preferably represents fluorine or chlorine.

In the general formula (IV), $R^5$ preferably represents a hydrogen atom, an alkyl group or a halogen atom. Where $R^5$ is an alkyl group, this alkyl group may form a 5-membered or 6-membered ring in combination with $R^9$. $R^5$ particularly represents a hydrogen atom.

In the general formula (IV), $R^6$ preferably represents a hydrogen atom, a halogen atom, an alkyl group, an alkoxy group, a sulfonamido group or a cyano group.

In the general formula (IV), $R^9$ preferably represents a hydrogen atom or an unsubstituted alkyl group having 1 to 22 carbon atoms.

In the general formula (IV), $R^{10}$ preferably represents a halogen atom, an alkyl group, a sulfonamido group, a sulfamoyl group, a sulfamido group, an acylamino group, a carbamoyl group, an alkoxy group, an aryloxy group, an imido group, a ureido group, a cyano group or a nitro group, which each may be substituted. Examples of the substituents for the group $R^{10}$ include the same substituents as those for the groups $R^1$ and $R^4$. Preferred examples of substituents for the group $R^{10}$ include chlorine, an alkyl group, a sulfonamido group, a sulfamoyl group, a sulfamido group, an alkoxy group, a cyano group, and a nitro group.

In the general formula (IV), $X^2$ preferably represents a hydrogen atom, a halogen atom, an alkoxy group or an aryloxy group, and $X^2$ particularly preferably represents a hydrogen atom, fluorine, or chlorine.

The ratio in which the coupler represented by the general formula (I) or (III) (herinafter referred to as "Coupler A") and the coupler represented by the general formula (II) or (IV) (hereinafter referred to as "Coupler B") are mixed can be selected in a fairly wide range. For the purpose of the present invention, Coupler A is added preferably in a range of 2 mol% to 80 mol%, more preferably in a range of 5 mol% to 60 mol%, and particularly preferably in a range of 20 mol% to 60 mol% (Coupler B added to fill the balance to make up 100 mol%). Just one Coupler A or a plurality of Coupler A's selected from the group indicated above and just one Coupler B or a plurality of Coupler B's similarly selected are mixed and put to use.

The present invention is particularly preferred when at least one coupler represented by the general formula (I) and at least one coupler represented by the general formula (II) are incorporated in one and the same layer.

The couplers of the present invention are generally added in a total amount of $1\times10^{-3}$ mol to $7\times10^{-1}$ mol, preferably $1\times10^{-2}$ mol to $5\times10^{-1}$ mol, per mol of silver contained in the emulsion layer.

The aforementioned Coupler A possesses a hue desirable from the viewpoint of color reproduction and exhibits a high color forming property, reacting with a color developer containing benzyl alcohol. It nevertheless suffers from a disadvantage that it exhibits an inferior color forming property, reacting with a color developer containing no benzyl alcohol and also entails a disadvantage that it possesses notably poor fastness to heat. On the other hand, the aforementioned Coupler B absorbs light having short wavelength and possesses a hue undesirable from the viewpoint of color reproduction. Although a color forming property of Coupler B hardly depends upon the presence or absence of benzyl alcohol, Coupler B is slightly inferior to Coupler A in color forming property.

The present inventors continued a study on various couplers and explored their properties. They have, consequently, found that the combination of Coupler A and Coupler B contemplated by the present invention exhibits the most desirable color forming property and hue. Generally when dyes having dissimilar hues are mixed, the half-width of the absorption is increased so much as to give rise to a cause for color turbidity. The combination of couplers contemplated by the present invention does not entail any such undesired phenomenon. The combination of the present invention enables the hue to be adjusted without any increase to the half-width. As concerns the color forming property, the combination of couplers brings about a truly surprising effect of exhibiting a much better color forming property even in a color developer containing no benzyl alcohol than when the same couplers are used independently of each other.

Specific examples of the couplers which can be effectively used in the present invention are illustrated below, but the present invention should not be construed as being limited thereto.

[Coupler A]

(A-1)

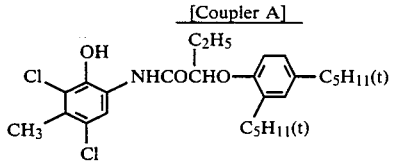

(A-2)

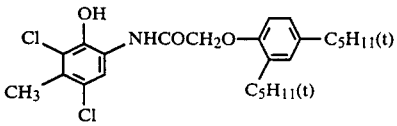

-continued (A-3)

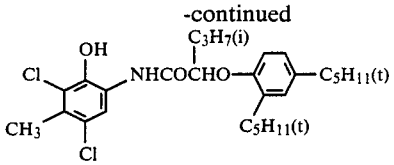

(A-4)

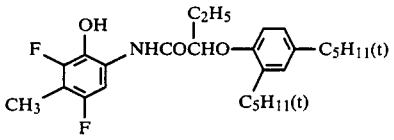

(A-5)

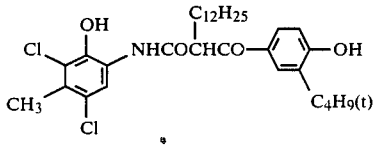

(A-6)

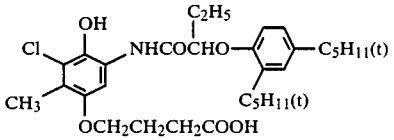

(A-7)

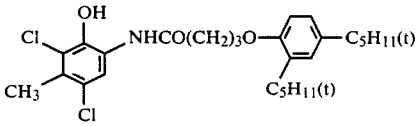

(A-8)

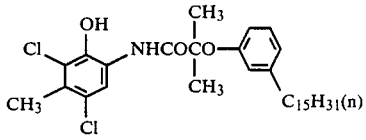

(A-9)

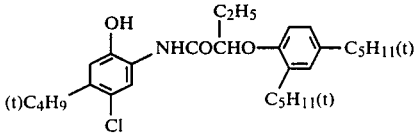

(A-10)

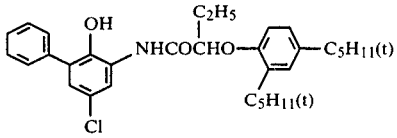

(A-11)

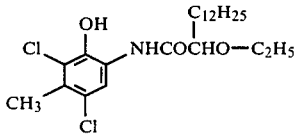

(A-12)

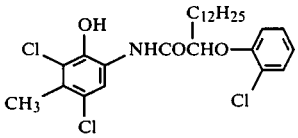

(A-13)

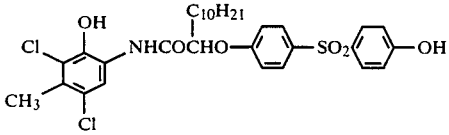

-continued
[Coupler B]
(B-1)
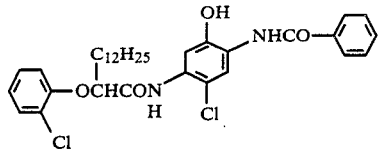
(B-2)
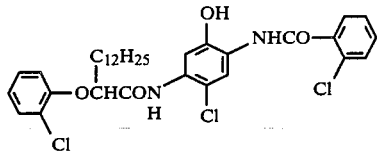
(B-3)
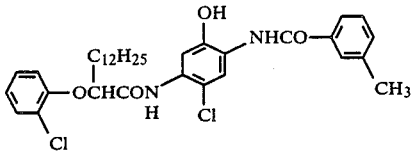
(B-4)
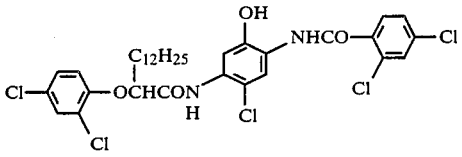
(B-5)
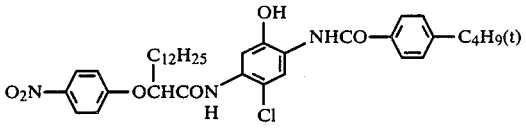
(B-6)
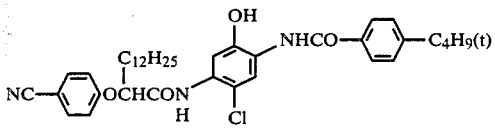
(B-7)
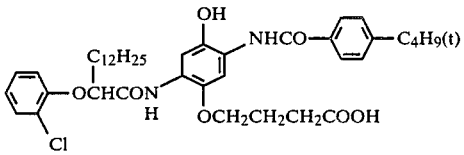
(B-8)
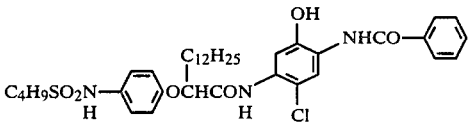
(B-9)
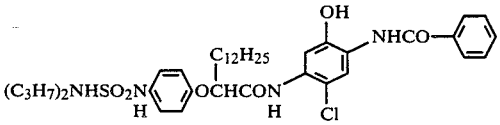
(B-10)
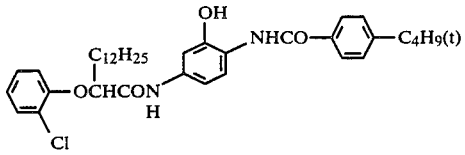
-continued
(B-11)
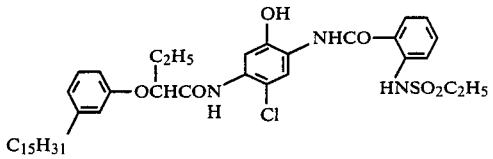
(B-12)
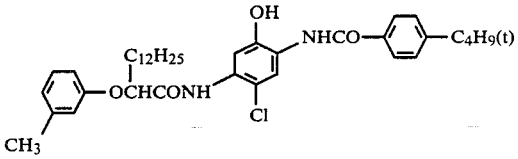
(B-13)
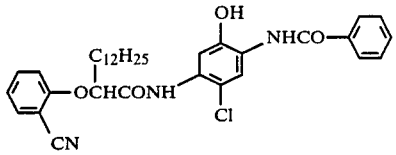
(B-14)
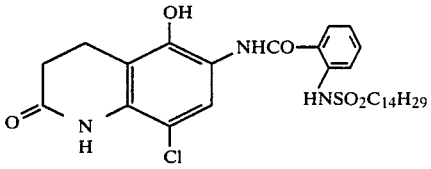
(B-15)
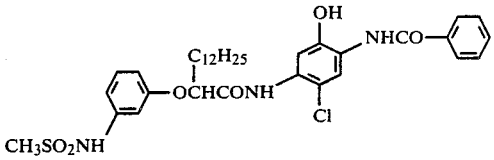
(B-16)
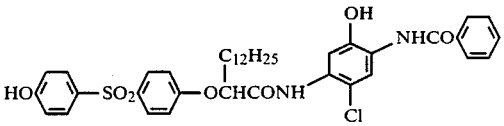
The couplers of the present invention can be synthesized according to the novel manners represented by the following synthesis scheme.
Coupler A
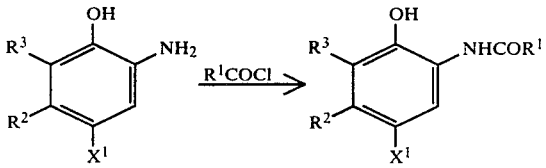
Coupler B
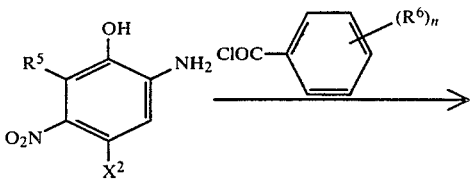

-continued

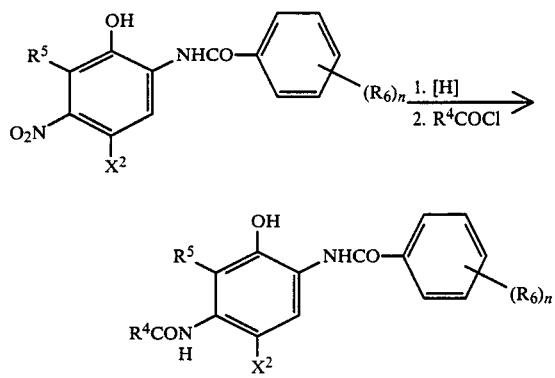

Here, $R^1$ through $R^6$−, n and X have the same meaning as defined above.

Specifically, any Coupler A can be synthesized by the method disclosed in U.S. Pat. No. 2,423,730.

Now, Coupler B can be synthesized by the methods described below. The present invention, however, should not be construed as being limited thereto.

SYNTHESIS EXAMPLE 1

Synthesis of Coupler (B-1)

In 2.5 liters of acetonitrile, 396 g of 2-amino-4-chloro-5-nitrophenol was suspended and refluxed under heating. Into the refluxed mixture, 418 g of 4-tert-butylbenzoyl chloride was added dropwise over a period of 30 minutes. The reflux under heating was further continued for 1 hour and the resulting mixture was cooled. The crystals which were precipitated therein were collected by filtration, washed with acetonitrile, and dried. Consequently, 580 g of crystals were obtained (melting point: 242° to 247° C.). These crystals and 466 g of iron powder, 350 ml of cold water, 2 liters of isopropanol, and 30 ml of hydrochloric acid added thereto were refluxed under heating for 1 hour.

The iron powder was separated off by filtration. The crystals consequently precipitated were collected by filtration and dried. Consequently, there was obtained 480 g of 5-amino-2-(4-tert-butylbenzoylamino)-4-chlorophenol (melting point 164° C. to 165° C.).

In 700 ml of acetonitrile, 95.7 g of 5-amino-2-(4-tert-butylbenzoylamino)-4-chlorophenol was refluxed under heating. Into the refluxed mixture, 124.5 g of 2-(2-chlorophenoxy)tetradecanoyl chloride was added dropwise over a period of 1 hour. The reflux under heating was continued further for 2 hours. The resulting reaction mixture was combined with 1 liter of ethyl acetate and washed with cold water. The mixture was subjected to vacuum distillation to expel the solvent and crystallized from 200 ml of ethyl acetate and 300 ml of acetonitrile. The resulting crystals were subjected to recrystallization. Consequently, there was obtained 152 g of the example Coupler (B-1) having a boiling point of 111° C. to 113° C.

Elementary Analysis Found (%): C: 67.62 H: 7.31 N; 4.35. Calculated (%): C: 67.77 H; 7.38 N; 4.27.

SYNTHESIS EXAMPLE 2

Synthesis of Coupler (B-12)

By following the procedure of Synthesis Example 1, 93 g of Coupler (6) was obtained from 63.1 g of 5-amino-2-(4-tert-butylbenzoylamino)-4-chlorophenol and 73 g of 2-(3-methylphenoxy)tetradecanoyl chloride. Melting Point: 119° C. to 120° C.

The other couplers can be synthesized by following the same procedure as described above.

The coupler of the present invention can be incorporated into the silver halide emulsion layer by any of the conventional methods. The information concerning the other couplers, solvents, ultraviolet ray absorption agents, protective colloids, binders, antifogging agents, color mixture preventing agents, sensitizing dyes, dyes, and bleaching agents which can be incorporated in addition to the couplers of the present invention and the information concerning the formation of silver halide light-sensitive materials (such as the method for the formation of photographic emulsion, the incorporation of couplers, the support and the layer construction of light-sensitive layers) and the photographic treatments are described in *Research Disclosure,* December 1978, Item 17643 (Industrial Opportunities Ltd. UK) and Japanese Patent Application (OPI) Nos. 65134/81 and 104333/81 (the term "OPI" as used herein refers to a "published unexamined Japanese patent application") and in the pieces of literature cited in these publications.

The present invention is explained in greater detail with reference to the examples below, but the present invention should not be construed as being limited thereto.

EXAMPLE 1

Multilayer color light-sensitive films (Test Samples 1 to 12) were prepared each by superposing on a cellulose triacetate support a varying set of first (lowermost) layer through sixth (uppermost) layer indicated below. (In the following table, the denomination mg/m² expresses the amount of a given substance applied.)

TABLE 1

| | | |
|---|---|---|
| Sixth Layer (protective layer) | Gelatin | 750 mg/m² |
| Fifth Layer (green-sensitive layer) | Silver chlorobromide emulsion (silver bromide 30 mol %, silver 500 mg/m²) | |
| | Gelatin | 1,300 mg/m² |
| | Sensitizing dye (*1) | 2.1 mg/m² |
| | Magenta coupler (*2) | 600 mg/m² |
| | Coupler solvent (*3) | 110 mg/m² |
| Fourth Layer | Gelatin | 500 mg/m² |
| Third Layer | Silver chlorobromide emulsion (silver bromide 30 mol %, silver 500 mg/m²) | |
| | Gelatin | 2,900 mg/m² |
| | Sensitizing dye (*4) | 0.2 mg/m² |
| | Cyan coupler (*5) | 1,500 mg/m² |
| | Ultraviolet ray absorbing agent (*6) | 400 mg/m² |
| | Coupler solvent (*7) | 700 mg/m² |
| Second Layer | Gelatin | 500 mg/m² |
| First Layer (blue-sensitive layer) | Silver iodobromide emulsion (silver iodide 0.2 mol %, silver 1,000 mg/m²) | |
| | Gelatin | 2,200 mg/m² |
| | Yellow coupler (*8) | 1,200 mg/m² |
| | Coupler solvent (*9) | 600 mg/m² |

TABLE 1-continued

| Support | Cellulose triacetate |
|---|---|

(*1) Sensitizing Dye:
Triethylammonium-4-[6-chloro-5-cyano-1-ethyl-2-{3-[5-phenyl-3-(4-sulfonato-butyl)benzooxazolin-2-ylidene]-1-propenyl}benzimidazolium-3]butane sulfonate
(*2) Magenta Coupler:
3-(2-Chloro-5-tetradecanamidoanilino)-1-(2,4,6-trichlorophenyl)-2-pyrazolin-5-one
(*3) Coupler Solvent:
Tricresyl phosphate
(*4) Sensitizing Dye:
Potassium 2-{5-[4-(6-methyl-3-pentylbenzothiazolin-2-ylidene)-2-methyl-2-butylidene]-3-rhodanin}acetate
(*5) Cyan Coupler:
To be selected in accordance with the Test Films No. 1 to No. 12 of Table 2.
(*6) Ultraviolet Ray Absorbing Agent:
A mixture of Tinuvin 326 (30%) + Tinuvin 327 (30%) + Tinuvin 328 (40%) made by Ciba Geigy of Switzerland.
(*7) Coupler Solvent:
To be selected in accordance with the Test Films No. 1 to No. 12 of Table 2.
(*8) Yellow Coupler:
α-(4-Methoxybenzoyl)-α-(3-benzyl-4-ethoxybitanto-1-yl)-2-chloro-5-dodecyloxycarbonyl acetanilide
(*9) Coupler Solvent:
Dibutyl phthalate The Test Films No. 1 to No. 12 were prepared by using a varying coupler and a varying coupler solvent indicated in Table 2 in the respective third layers.

The test films were exposed through a continuous wedge to blue light, green light and red light and then subjected to the following treatment for development.

The test films which had undergone this treatment were tested for optical density with respect to red light. Consequently, the values of gamma and those of maximum density indicated in Table 3 were obtained.

Then for the purpose of evaluating the hues of the developed test films, the test films were tested for spectral density of cyan color images by the use of an autorecording spectrophotometer, Model 340, made by Hitachi Ltd. The values of maximum density wavelength ($\lambda_{max}$) and shortwave side absorption half-width ($\lambda_{\frac{1}{2}}$) thus obtained were as shown in Table 3.

Further, the developed test films were tested for fastness of cyan color image. The fastness of a give test film after 3 days' standing in a dark place at 100° C., the fastness thereof after 6 weeks' standing in a dark place at 60° C. and 70% RH, and the fastness thereof after 7 days' exposure to a xenon tester (20,000 luxes) were expressed in terms of loss of density relative to the initial density taken as 1.0. The results are shown in Table 4.

| Treatment for Development | | |
|---|---|---|
| Color Development | 36° C. | 3 minutes |
| Stop of Development | 36° C. | 40 seconds |
| First Fixation | 36° C. | 40 seconds |
| Bleaching | 36° C. | 1 minute |
| Second Fixation | 36° C. | 40 seconds |
| Washing with Water | 30° C. | 30 seconds |
| Drying | | |
| **Composition of color Developer** | | |
| Sodium Sulfite | | 5 g |
| 4-Amino-3-methyl-N,N—diethylaniline | | 3 g |
| Sodium Carbonate | | 20 g |
| Potassium Bromide | | 2 g |
| Water to make | | 1 liter |
| | | pH 10.5 |
| **Composition for Stopping Solution** | | |
| Sulfuric Acid (6 N) | | 50 ml |
| Water to make | | 1 liter |
| | | pH 1.0 |
| **Composition for Fixing Solution** | | |
| Ammonium Thiosulfate | | 60 g |
| Sodium Sulfite | | 2 g |
| Sodium Hydrogensulfite | | 10 g |
| Water to make | | 1 liter |
| | | pH 5.8 |
| **Composition for Bleaching Solution** | | |
| Potassium Ferricyanide | | 30 g |
| Potassium Bromide | | 15 g |
| Water to make | | 1 liter |
| | | pH 6.5 |

TABLE 2

| Test Film | (A) Coupler and Amount Added ($\times 10^{-1}$ mol/mol of silver) | (B) Coupler and Amount Added ($\times 10^{-1}$ mol/mol of silver) | Coupler Solvent |
|---|---|---|---|
| 1 (Comparison) | — | B-1 4.0 | *S-1 (60%) + *S-2 (40%) |
| 2 (This Invention) | A-1 0.4 | B-1 3.6 | *S-1 (60%) + *S-2 (40%) |
| 3 (This Invention) | A-1 0.8 | B-1 3.2 | *S-1 (60%) + *S-2 (40%) |
| 4 (This Invention) | A-1 1.2 | B-1 2.8 | *S-1 (60%) + *S-2 (40%) |
| 5 (This Invention) | A-1 1.6 | B-1 2.4 | *S-1 (60%) + *S-2 (40%) |
| 6 (Comparison) | A-1 4.0 | — | *S-1 (60%) + *S-2 (40%) |
| 7 (Comparison) | — | B-3 4.0 | *S-1 (100%) |
| 8 (This Invention) | A-2 0.4 | B-3 3.6 | " |
| 9 (This Invention) | A-2 0.8 | B-3 3.2 | " |
| 10 (This Invention) | A-2 1.2 | B-3 2.8 | " |
| 11 (This Invention) | A-2 1.6 | B-3 2.4 | " |
| 12 (Comparison) | A-2 4.0 | — | " |

*S-1: Dibutyl Phthalate.
*S-2: 2,4-Di-tert-amylphenol

TABLE 3

| | Test Film | Color Hue* $\lambda_{max}$ (nm) | Color Hue* $\lambda_{\frac{1}{2}}$ (nm) | Color Forming Property Gamma | Color Forming Property Maximum Density |
|---|---|---|---|---|---|
| 1 | (Comparison) | 653 | 70 | 3.76 | 3.40 |
| 2 | (This Invention) | 658 | 70 | 3.84 | 3.51 |
| 3 | " | 663 | 70 | 3.85 | 3.53 |
| 4 | " | 665 | 70 | 3.85 | 3.52 |
| 5 | " | 668 | 70 | 3.81 | 3.50 |
| 6 | (Comparison) | 670 | 70 | 3.58 | 3.45 |
| 7 | " | 648 | 68 | 3.64 | 3.31 |
| 8 | (This Invention) | 653 | 68 | 3.70 | 3.42 |
| 9 | " | 656 | 68 | 3.72 | 3.46 |
| 10 | " | 658 | 68 | 3.73 | 3.47 |
| 11 | " | 661 | 69 | 3.73 | 3.46 |
| 12 | (Comparison) | 665 | 69 | 3.60 | 3.39 |

*Method for determination of $\lambda_{\frac{1}{2}}$

The difference between the wavelength exhibiting 50% of absorption strength of the maximum absorption strength of a given spectrum and the wavelength of the maximum density was reported as the value of half-width.

TABLE 4

| | Test Film | Fastness of Color Image (ratio of loss, %) After 3 Days' Standing at 100° C. | After 6 Weeks' Standing at 60° C., 70% RH | After 7 Days' Exposure to Light (xenon) |
|---|---|---|---|---|
| 1 | (Comparison) | 10 | 3.5 | 11 |
| 2 | (This Invention) | 11 | 4 | 11 |
| 3 | " | 12.5 | 4 | 11 |
| 4 | " | 14 | 5 | 11 |
| 5 | " | 17 | 7 | 12 |
| 6 | (Comparison) | 52 | 23 | 14 |
| 7 | " | 8 | 2.0 | 8 |
| 8 | (This Invention) | 8 | 3 | 8 |
| 9 | " | 11 | 3 | 9 |
| 10 | " | 13 | 5 | 10 |
| 11 | " | 16 | 6 | 11 |
| 12 | (Comparison) | 47 | 21 | 13 |

From the results of Table 3 and Table 4, it is noted that the combined use of the couplers in accordance with the present invention resulted in superior color forming property (high gamma and high maximum density) and superior color image fastness to when the same couplers were used independently of each other and that the combinations of the couplers permitted adjustment of hue without entailing any increase to the half-width of absorption.

EXAMPLE 2

A color photographic light-sensitive material (Test Film 13) was prepared by superposing on a paper support having both sides coated with polyethylene the first layer (lowermost layer) to the sixth layer (uppermost layer) of the following compositions in the order mentioned. (In Table 5, the denomination mg/m$^2$ represents the amount of a give substance applied).

TABLE 5

| | | |
|---|---|---|
| Sixth Layer (protective layer) | Gelatin | 1,600 mg/m$^2$ |
| Fifth Layer (red-sensitive layer) | Silver chlorobromide emulsion (silver bromide 50 mol %), silver | 300 mg/m$^2$ |
| | Cyan coupler (*1) | 400 mg/m$^2$ |
| | Coupler solvent (*2) | 300 mg/m$^2$ |
| | Gelatin | 500 mg/m$^2$ |
| Fourth Layer (ultraviolet ray absorbing layer) | Ultraviolet ray absorbing agent (*3) | 600 mg/m$^2$ |
| | Ultraviolet ray absorbing agent solvent (*2) | 300 mg/m$^2$ |
| | Gelatin | 800 mg/m$^2$ |
| Third Layer (green-sensitive layer) | Silver chlorobromide emulsion (silver bromide 70 mol %), silver | 500 mg/m$^2$ |
| | Magenta coupler (*4) | 400 mg/m$^2$ |
| | Antidiscoloration agent (*5) | 200 mg/m$^2$ |
| | Coupler solvent (*6) | 400 mg/m$^2$ |
| | Gelatin | 700 mg/m$^2$ |
| Second Layer (intermediate layer) | Gelatin | 1,000 mg/m$^2$ |
| First Layer (blue-sensitive layer) | Silver chlorobromide emulsion (silver bromide 80 mol %), silver | 400 mg/m$^2$ |
| | Yellow coupler (*7) | 500 mg/m$^2$ |
| | Coupler solvent (*2) | 400 mg/m$^2$ |
| | Gelatin | 700 mg/m$^2$ |
| Support | Paper having both sides coated with polyethylene | |

TABLE 5-continued (*1) Coupler:
2-[α-(2,4-Di-tert-pentylphenoxy)butanamido]-4,6-dichloro-5-methylphenol
(*2) Solvent:
Trinonyl phosphate
(*3) Ultraviolet Ray Absorbing Agent:
2-(2-Hydroxy-3-sec-butyl-5-tert-butylphenol)benzotriazole
(*4) Coupler:
1-(2,4,6-Trichlorophenyl)-3-(2-chloro-5-tetradecanamido)anilino-2-pyrazolon-5-one
(*5) Antidiscoloration Agent:
2,5-Di-tert-hexylhydroquinone
(*6) Solvent:
Tricresyl phosphate
(*7) Coupler:
α-Pivaloyl-α-(2,4-dioxy-5,5'-dimethyloxazolidin-3-yl)-2-chloro-5-[α-(2,4-di-tert-pentyloxy)butanamido]acetanilide Test Films No. 14 through No. 18 were prepared by following the procedure of Test Film 13 except that the cyan couplers of Table 6 were used in place of the cyan coupler of Test Film 13.

TABLE 6

| Test Film | Cyan Coupler | | | |
|---|---|---|---|---|
| 13 | (A-1) | 400 mg/m$^2$ | | |
| 14 | (A-1) | 320 mg/m$^2$ | (B-1) | 106 mg/m$^2$ |
| 15 | (A-1) | 240 mg/m$^2$ | (B-1) | 212 mg/m$^2$ |
| 16 | (A-1) | 160 mg/m$^2$ | (B-1) | 318 mg/m$^2$ |
| 17 | (A-1) | 80 mg/m$^2$ | (B-1) | 424 mg/m$^2$ |
| 18 | | | (B-1) | 530 mg/m$^2$ |

The test films were exposed through continuous wedge to red light and then treated by the method indicated below.

| Process of Treatment | | | |
|---|---|---|---|
| Color Development | 33° C. | 3 minutes | 30 seconds |
| Bleach-Fixing | 33° C. | 1 minute | 30 seconds |
| Washing with Water | 33° C. | 3 minutes | |
| Drying | | | |

| Composition of Color Developer | |
|---|---|
| Benzyl Alcohol | 15 ml |
| Sodium Sulfite | 5 g |
| Hydroxylamine Sulfate | 0.4 g |
| 4-(N—ethyl-N—β-methanesulfonamido)-2-methylaniline Sesquisulfate | 2 g |
| Sodium Carbonate (monohydrate) | 30 g |
| Water to make | 1,000 ml |
| | pH 10.1 |

| Bleach-Fixing Solution | |
|---|---|
| Ferric Ethylenediaminetetraacetate | 45 g |
| Sodium Sulfite | 10 g |
| Aqueous 70% Ammonium Thiosulfate Solution | 160 ml |
| Tetrasodium Ethylenediaminetetraacetate | 5 g |
| Water to make | 1,000 ml |
| | pH 6.8 |

The developed test films were tested for produced color density. The test results on fog, gamma, and maximum density were as shown in Table 7.

TABLE 7

| Test Film | Fog | Gamma | Maximum Density | |
|---|---|---|---|---|
| 13 | 0.11 | 2.84 | 2.95 | Comparison |
| 14 | 0.12 | 2.96 | 3.03 | This Invention |
| 15 | 0.11 | 3.03 | 3.05 | " |
| 16 | 0.11 | 3.01 | 3.02 | " |
| 17 | 0.11 | 2.90 | 3.07 | " |
| 18 | 0.12 | 2.73 | 2.93 | Comparison |

From the table, it is noted that the combined use of couplers according to the present invention resulted in superior color forming property to when the same couplers were used independently of each other.

Then, the developed Test Films No. 13 through No. 18 were tested for spectral absorption density by the use of an autorecording spectrophotometer, Model 340, made by Hitachi Ltd. The results were as shown in Table 8.

TABLE 8

| Test Film | Maximum Absorption Wavelength (nm) | Half-Width $\lambda_{\frac{1}{2}}$ (shortwave side) (nm) | |
|---|---|---|---|
| 13 | 659 | 96 | Comparison |
| 14 | 658 | 97 | This Invention |
| 15 | 655 | 96 | " |
| 16 | 653 | 97 | " |
| 17 | 649 | 97 | " |
| 18 | 646 | 97 | Comparison |

From the table, it is noted that the present invention permits adjustment of hue without entailing any increase to the half-width of absorption.

While the invention has been described in detail and with reference to specific embodiments thereof, it will be apparent to one skilled in the art that various changes and modifications can be made therein without departing from the spirit and scope thereof.

What is claimed is:

1. A silver halide color photographic light-sensitive material comprising a support having thereon a cyan dye forming coupler represented by the following general formula (I) and a cyan dye forming coupler represented by the following general formula (II):

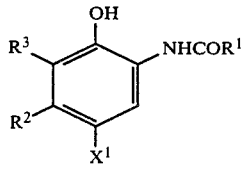

(I)

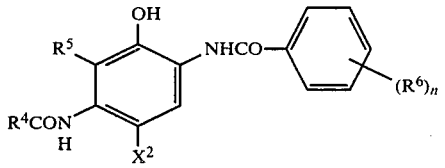

(II)

wherein $R^1$ and $R^4$ each represents a substituted or unsubstituted alkyl, aryl or heterocyclic group, $R^2$, $R^3$ and $R^5$ each represents a hydrogen atom, a halogen atom or a substituted or unsubstituted alkyl or aryl group, $R^6$ represents a group with which a benzene ring can be substituted, $X^1$ and $X^2$ each represents a group which can be released upon an oxidative coupling reaction with a developing agent, $R^4$ and $R^5$ may combine together to form a 5-membered or 6-membered ring, and n represents an integer of 1 to 5.

2. A silver halide color photographic light-sensitive material as claimed in claim 1, wherein $R^1$ and $R^4$ each represents a substituted or unsubstituted alkyl group having 1 to 32 carbon atoms, a substituted or unsubstituted aryl group having 3 to 32 carbon atoms or a substituted or unsubstituted 5-membered or 6-membered heterocyclic group having 1 to 32 carbon atoms.

3. A silver halide color photographic light-sensitive material as claimed in claim 1, wherein the substituents for the groups $R^1$ and $R^4$ each is selected from the group consisting of alkyl groups, aryl groups, heterocyclic groups, alkoxy groups, aryloxy groups, a carboxy group, carbonyl groups, ester groups, amido groups, sulfamido groups, imido groups, ureido groups, sulfonyl groups, a hydroxy group, a cyano group, a nitro group, halogen atoms and thio groups.

4. A silver halide color photographic light-sensitive material as claimed in claim 1, wherein the substituents for the groups $R^2$, $R^3$ and $R^5$ each is selected from the group consisting of alkyl groups, aryl groups, heterocyclic groups, alkoxy groups, aryloxy groups, a carboxy group, carbonyl groups, ester groups, amino groups, sulfamido groups, imido groups, ureido groups, sulfonyl groups, a hydroxy group, a cyano group, a nitro group, halogen atoms and thio groups.

5. A silver halide color photographic light-sensitive material as claimed in claim 1, wherein $R^6$ represents alkyl groups, aryl groups, heterocyclic groups, alkoxy groups, aryloxy groups, a carboxy group, carbonyl groups, ester groups, amino groups, sulfamido groups, imido groups, ureido groups, sulfonyl groups, a hydroxy groups, a cyano group, a nitro group, halogen atoms, thio groups and a hydrogen atom.

6. A silver halide color photographic light-sensitive material as claimed in claim 1, wherein $X^1$ and $X^2$ each represents a hydrogen atom, halogen atoms, alkoxy groups, aryloxy groups, acyloxy groups, sulfonyloxy groups, amido groups, alkoxycarbonyloxy groups, aryloxycarbonyloxy groups, thio groups and imido groups.

7. A silver halide color photographic light-sensitive material as claimed in claim 1, wherein the cyan coupler represented by the general formula (I) is substituted with a cyan represented by the general formula (III):

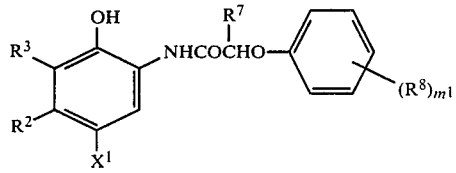

(III)

wherein $R^2$ and $R^3$ each represents a hydrogen atom, a halogen atom or a substituted or unsubstituted alkyl, or aryl group, $R^7$ represents a hydrogen atom or a substituted or unsubstituted alkyl group, $R^8$ represents a group with which a benzene ring can be substituted, $X^1$ represents a group which can be released upon an oxidative coupling reaction with a developing agent, and $m^1$ represents an integer of 1 to 5.

8. A silver halide color photographic light-sensitive material as claimed in claim 1, wherein the cyan coupler represented by the general formula (II) is substituted with a cyan represented by the general formula (IV):

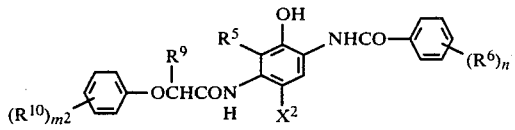

(IV)

wherein $R^5$ represents a hydrogen atom, a halogen atom, or a substituted or unsubstituted alkyl or aryl group, $R^6$ represents a group with which a benzene ring can be substituted, $R^9$ represents a hydrogen atom or a substituted or unsubstituted alkyl group, $R^{10}$ represents a group with which a benzene ring can be substituted, $R^5$ and $R^9$ may combine together to form a 5-membered or 6-membered ring, $X^2$ represents a group which can be released upon an oxidative coupling reaction with a developing agent, n represents an integer of 1 to 5, and $m^2$ represents an integer of 1 to 5.

9. A silver halide color photographic light-sensitive material as claimed in claim 1, wherein the cyan coupler represented by the general formula (I) is added in a range of 2 mol% to 80 mol% (the cyan coupler represented by the general formula (II) added to fill the balance to make up 100 mol%).

10. A silver halide color photographic light-sensitive material as claimed in claim 1, wherein the couplers are added in a total amount of $1\times10^{-3}$ mol to $7\times10^{-1}$ mol per mol of silver contained in the emulsion layer.

* * * * *

UNITED STATES PATENT AND TRADEMARK OFFICE

CERTIFICATE OF CORRECTION

PATENT NO. : 4,552,836

DATED : November 12, 1985

INVENTOR(S) : Osami Tanabe et al

It is certified that error appears in the above-identified patent and that said Letters Patent is hereby corrected as shown below:

Column 16, line 26, "and" should read --or--.

Column 16, line 32, "and" should read --or--.

Column 16, lines 35-36, cancel "substituted with a cyan".

Column 16, lines 57-58, cancel "substituted with a cyan".

UNITED STATES PATENT AND TRADEMARK OFFICE

CERTIFICATE OF CORRECTION

PATENT NO. : 4,552,836

DATED : November 12, 1985

INVENTOR(S) : Osami Tanabe et al

It is certified that error appears in the above-identified patent and that said Letters Patent is hereby corrected as shown below:

Column 17, line 9, cancel beginning with "9. A silver halide" to and including "ance to make up 100 mol%)." in column 18, line 4, and insert the following claim:

9. A silver halide color photographic light-sensitive material as claimed in claim 1, wherein the cyan coupler represented by the general formula (I) is added in a range of 2 mol% to 80 mol%, the cyan coupler represented by the general formula (II) being added to make up 100 mol%.

Signed and Sealed this

*Eleventh* Day of *February 1986*

[SEAL]

*Attest:*

DONALD J. QUIGG

*Attesting Officer* *Commissioner of Patents and Trademarks*